US010132118B2

(12) United States Patent
Amezaga

(10) Patent No.: US 10,132,118 B2
(45) Date of Patent: Nov. 20, 2018

(54) DUAL TORQUE TRANSFER FOR TOP DRIVE SYSTEM

(71) Applicant: Weatherford Technology Holdings, LLC, Houston, TX (US)

(72) Inventor: Federico Amezaga, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 60 days.

(21) Appl. No.: 15/447,881

(22) Filed: Mar. 2, 2017

(65) Prior Publication Data

US 2018/0252041 A1 Sep. 6, 2018

(51) Int. Cl.

| | |
|---|---|
| ***E21B 3/02*** | (2006.01) |
| ***E21B 4/02*** | (2006.01) |
| ***E21B 4/04*** | (2006.01) |
| ***E21B 4/20*** | (2006.01) |
| ***E21B 7/00*** | (2006.01) |

(52) U.S. Cl.

CPC ..... *E21B 7/002* (2013.01); *E21B 4/02* (2013.01); *E21B 4/04* (2013.01); *E21B 4/20* (2013.01)

(58) Field of Classification Search

CPC ..... E21B 4/04; E21B 4/20; E21B 4/02; E21B 3/02; E21B 3/025; E21B 3/03; E21B 19/06; E21B 19/16

USPC ..... 74/397

See application file for complete search history.

(56) References Cited

U.S. PATENT DOCUMENTS

| | | | |
|---|---|---|---|
| 4,497,224 | A | 2/1985 | Jurgens |
| 5,433,279 | A | 7/1995 | Tessari et al. |
| 6,908,121 | B2 | 6/2005 | Hirth et al. |
| 7,665,531 | B2 | 2/2010 | Pietras |
| 7,874,352 | B2 | 1/2011 | Odell, II et al. |
| 7,971,637 | B2 | 7/2011 | Duhon et al. |

(Continued)

FOREIGN PATENT DOCUMENTS

| | | | |
|---|---|---|---|
| AU | 2014215938 | A1 | 9/2014 |
| EP | 1961912 | A1 | 8/2008 |
| EP | 1961913 | A1 | 8/2008 |

OTHER PUBLICATIONS

Lefevre,Bruno et al., "Deeper, more deviated wells push development of smart drill stem rotary shouldered connections," Drilling Technology, (2008), pp. 130-132.

(Continued)

*Primary Examiner* — D. Andrews
*Assistant Examiner* — Dany E Akakpo
(74) *Attorney, Agent, or Firm* — Patterson & Sheridan, L.L.P.

(57) ABSTRACT

A method and apparatus for a drive unit of a top drive system including a first, second, and third drive gears that are operationally coupled; a motor engagable with the first drive gear; a drive stem having a load coupling and engagable with the second drive gear; and a torque shaft having a torque coupling and engagable with the third drive gear. The drive stem cannot engage with the second drive gear when the torque shaft is engaged with the third drive gear. A method of coupling a drive unit to a tool adapter includes engaging a first drive gear with a motor of the drive unit while engaging a second drive gear with a drive stem of the drive unit; coupling a load between the drive stem and a tool stem of the tool adapter; and coupling a torque between a torque shaft of the drive unit and the tool stem.

20 Claims, 12 Drawing Sheets

(56) References Cited

U.S. PATENT DOCUMENTS

| | | | | |
|---|---|---|---|---|
| 8,708,055 | B2 | 4/2014 | Liess et al. | |
| 8,727,021 | B2 | 5/2014 | Heidecke et al. | |
| 8,776,898 | B2 | 7/2014 | Liess et al. | |
| 9,206,851 | B2 | 12/2015 | Slaughter, Jr. et al. | |
| 2003/0221519 | A1 | 12/2003 | Haugen | |
| 2004/0069497 | A1 | 4/2004 | Jones et al. | |
| 2005/0269072 | A1 | 12/2005 | Folk et al. | |
| 2008/0093127 | A1 | 4/2008 | Angman | |
| 2009/0151934 | A1 | 6/2009 | Heidecke et al. | |
| 2011/0088495 | A1 | 4/2011 | Buck et al. | |
| 2013/0055858 | A1 | 3/2013 | Richardson | |
| 2013/0056977 | A1 | 3/2013 | Henderson et al. | |
| 2013/0105178 | A1 | 5/2013 | Pietras | |
| 2013/0269926 | A1 | 10/2013 | Liess et al. | |
| 2014/0131052 | A1* | 5/2014 | Richardson | E21B 19/16 166/380 |
| 2014/0326468 | A1 | 11/2014 | Heidecke et al. | |
| 2016/0215592 | A1 | 7/2016 | Helms et al. | |
| 2017/0044875 | A1 | 2/2017 | Hebebrand et al. | |
| 2017/0067303 | A1 | 3/2017 | Thiemann et al. | |
| 2017/0067320 | A1 | 3/2017 | Zouhair et al. | |
| 2017/0074075 | A1 | 3/2017 | Liess | |

OTHER PUBLICATIONS

Rotary Sholder Handbook, 2010 National Oilwell Varco, D392002466-MKT-001 Rev.02,116 pages.

EPO Extended European Search Report dated Jul. 19, 2018, for European Application No. 18159595.0.

* cited by examiner

DUAL TORQUE TRANSFER FOR TOP DRIVE SYSTEM

BACKGROUND

Embodiments of the present invention generally relate to equipment and methods for coupling a top drive to one or more tools. The coupling may transfer both axial load and torque bi-directionally from the top drive to the one or more tools.

A wellbore is formed to access hydrocarbon-bearing formations (e.g., crude oil and/or natural gas) or for geothermal power generation by the use of drilling. Drilling is accomplished by utilizing a drill bit that is mounted on the end of a tool string. To drill within the wellbore to a predetermined depth, the tool string is often rotated by a top drive on a drilling rig. After drilling to a predetermined depth, the tool string and drill bit are removed, and a string of casing is lowered into the wellbore. Well construction and completion operations may then be conducted.

During drilling and well construction/completion, various tools are used which have to be attached to the top drive. The process of changing tools is very time consuming and dangerous, requiring personnel to work at heights. The attachments between the tools and the top drive typically include mechanical, electrical, optical, hydraulic, and/or pneumatic connections, conveying torque, load, data, signals, and/or power.

Typically, sections of a tool string are connected together with threaded connections. Such threaded connections are capable of transferring load. Right-hand (RH) threaded connections are also capable of transferring RH torque. However, application of left-hand (LH) torque to a tool string with RH threaded connections (and vice versa) risks breaking the string. Methods have been employed to obtain bi-directional torque holding capabilities for connections. Some examples of these bi-directional setting devices include thread locking mechanisms for saver subs, hydraulic locking rings, set screws, jam nuts, lock washers, keys, cross/thru-bolting, lock wires, clutches and thread locking compounds. However, these solutions have shortcomings. For example, many of the methods used to obtain bi-directional torque capabilities are limited by friction between component surfaces or compounds that typically result in a relative low torque resistant connection. Locking rings may provide only limited torque resistance, and it may be difficult to fully monitor any problem due to limited accessibility and location. For applications that require high bi-directional torque capabilities, only positive locking methods such as keys, clutches or cross/through-bolting are typically effective. Further, some high bi-directional torque connections require both turning and milling operations to manufacture, which increase the cost of the connection over just a turning operation required to manufacture a simple male-to-female threaded connection. Some high bi-directional torque connections also require significant additional components as compared to a simple male-to-female threaded connection, which adds to the cost.

Safer, faster, more reliable, and more efficient connections that are capable of conveying load, data, signals, power and/or bi-directional torque between the tool string and the top drive are needed.

SUMMARY OF THE INVENTION

The present invention generally relates to equipment and methods for coupling a top drive to one or more tools. The coupling may transfer both axial load and torque bi-directionally from the top drive to the one or more tools.

In an embodiment, a drive unit of a top drive system includes a first, second, and third drive gears, wherein the first, second, and third drive gears are operationally coupled; a motor engagable with the first drive gear; a drive stem having a load coupling and engagable with the second drive gear; and a torque shaft having a torque coupling and engagable with the third drive gear, wherein the drive stem cannot engage with the second drive gear when the torque shaft is engaged with the third drive gear, and vice versa.

In an embodiment, a method of coupling a drive unit to a tool adapter includes positioning the tool adapter below the drive unit; engaging a first drive gear with a motor of the drive unit while engaging a second drive gear with a drive stem of the drive unit; coupling a load between the drive stem and a tool stem of the tool adapter; and coupling a torque between a torque shaft of the drive unit and the tool stem.

In an embodiment, a top drive system includes a drive unit; a tool adapter having a tool stem; a first torque path including: a motor of the drive unit; a first pair of operationally coupled drive gears of the drive unit; a drive stem of the drive unit; a threaded connection between the drive stem and the tool stem; and a second torque path including: the motor; a second pair of operationally coupled drive gears of the drive unit; a torque shaft of the drive unit; and a torque coupling between the torque shaft and the tool stem.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention provides equipment and methods for coupling a top drive to one or more tools. The coupling may transfer torque bi-directionally from the top drive to the one or more tools. The coupling may provide mechanical, electrical, optical, hydraulic, and/or pneumatic connections. The coupling may convey torque, load, data, signals, and/or power. For example, axial loads of tool strings may be expected to be several hundred tons, up to, including, and sometimes surpassing 750 tons. Required torque transmission may be tens of thousands of foot-pounds, up to, including, and sometimes surpassing 100 thousand foot-pounds. Embodiments disclosed herein may provide axial connection integrity, capable to support high axial loads, good sealability, resistance to bending, high flow rates, and high flow pressures.

Some of the many benefits provided by embodiments of this disclosure include a reliable method to transfer full bi-directional torque, thereby reducing the risk of accidental breakout of threaded connections along the tool string. Embodiments of this disclosure also provide a fast, hands-free method to connect and transfer power from the drive unit to the tool adapter. Embodiments provide automatic connection for power and data communications.

In some embodiments, the torque transfer path from the top drive system to the tool string bypasses the threaded connection between the drive unit and the tool adapter. This may allow full bi-directional torque to be applied in the tool string. This compares to systems wherein the torque transfer path proceeds through the threaded connections between the drive unit and the tool adapter which present a risk of backing out the main threaded connection while rotating in the breakout direction.

Figure 1:
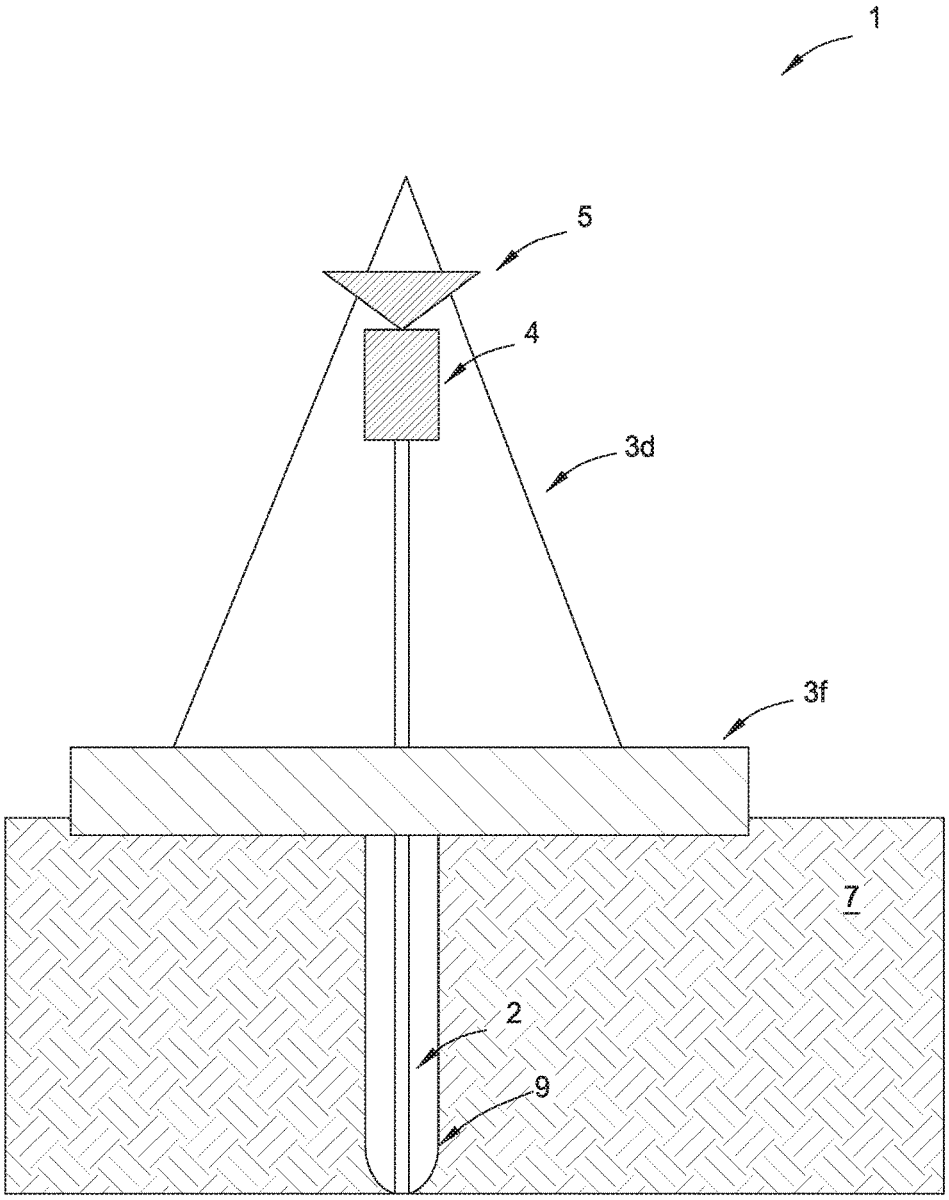
FIG. 1 illustrates a drilling system, according to embodiments of the present disclosure.

FIG. 1 illustrates a drilling system 1, according to embodiments of the present disclosure. The drilling system 1 may include a drilling rig derrick 3*d* on a drilling rig floor 3*f*. As illustrated, drilling rig floor 3*f* is at the surface of a subsurface formation 7, but the drilling system 1 may also be an offshore drilling unit, having a platform or subsea wellhead in place of or in addition to rig floor 3*f*. The derrick may support a hoist 5, thereby supporting a top drive 4. In some embodiments, the hoist 5 may be connected to the top drive 4 by threaded couplings. The top drive 4 may be connected to a tool string 2. At various times, top drive 4 may support the axial load of tool string 2. In some embodiments, the top drive 4 may be connected to the tool string 2 by threaded couplings. The rig floor 3*f* may have an opening through which the tool string 2 extends downwardly into a wellbore 9. At various times, rig floor 3*f* may support the axial load of tool string 2. During operation, top drive 4 may provide torque to tool string 2, for example to operate a drilling bit near the bottom of the wellbore 9. The tool string 2 may include joints of drill pipe connected together, such as by threaded couplings. At various times, top drive 4 may provide right hand (RH) torque or left hand (LH) torque to tool string 2, for example to make up or break out joints of drill pipe. Power and/or signals may be communicated between top drive 4 and tool string 2. For example, pneumatic, hydraulic, electrical, optical, or other power and/or signals may be communicated between top drive 4 and tool string 2. The top drive 4 may include a control unit, a drive unit, and a tool adapter. In some embodiments, the tool adapter may utilize threaded connections. In some embodiments, the tool adapter may be a combined multi-coupler (CMC) or quick connector to support load and transfer torque with couplings to transfer power (hydraulic, electric, data, and/or pneumatic).

Figure 2:
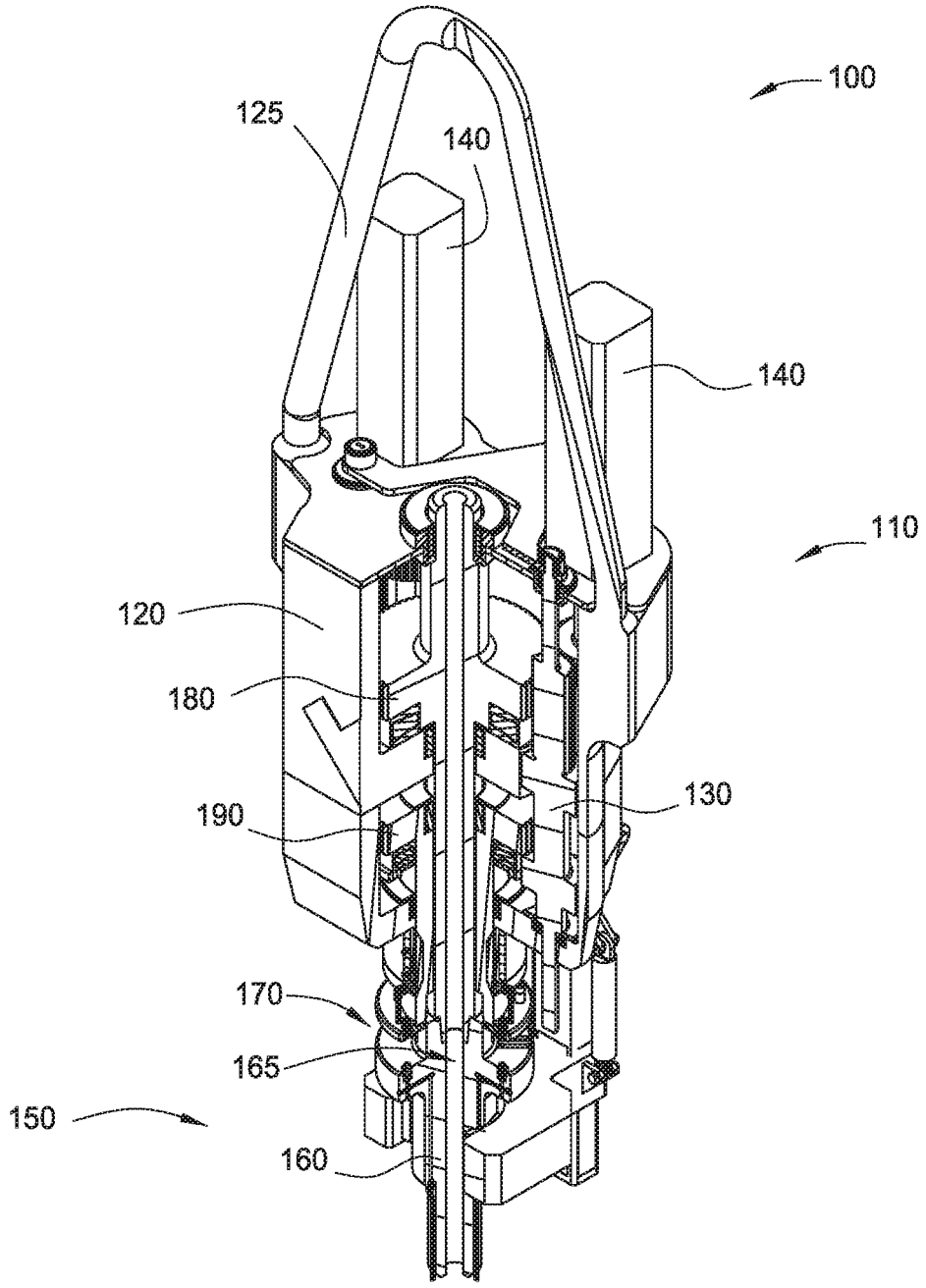
FIG. 2 illustrates a top drive system of the drilling system of FIG. 1.

FIG. 2 illustrates a top drive system 100 (e.g., top drive 4 in FIG. 1) according to embodiments described herein. Generally, top drive system 100 includes a drive unit 110 and a tool adapter 150. The drive unit 110 generally includes a housing 120, becket 125, sets of operationally coupled drive gears 130, motors 140 (e.g., electric or hydraulic motors), first portions of one or more couplings 170, a drive stem 180, and a torque shaft 190. Becket 125 may convey load from the top drive system 100 to the hoist 5. Becket 125 may be used with, or replaced by, other load-transfer components. Each set of drive gears 130 may convey torque between the motors 140 and the drive stem 180 and/or the torque shaft 190. As illustrated, top drive system 100 includes two sets of drive gears 130 (only one shown in FIG. 2) and two motors 140. Any number of sets of drive gears 130 and/or motors 140 may be considered to accommodate manufacturing and operational conditions. The motors may be installed fixed to the housing 120. The drive stem 180 may extend through a central bore of torque shaft 190. The tool adapter 150 generally includes a tool stem 160 and second portions of the couplings 170. Couplings 170 may include complementary components disposed in or on drive unit 110 and tool adapter 150. The tool stem 160 generally remains below the drive unit 110. (It should be understood that "below", "above", "vertically", "up", "down", and similar terms as used herein refer to the general orientation of top drive 4 as illustrated in FIG. 1. In some instances, the orientation may vary somewhat, in response to various operational conditions. In any instance wherein the central axis of the top drive system is not aligned precisely with the direction of gravitational force, "below", "above", "vertically", "up", "down", and similar terms should be understood to be along the central axis of the top drive system.) The tool stem 160 connects the top drive system 100 to the tool string 2. The tool stem 160 and drive stem 180 may share a central bore 165 (e.g. providing fluid communication through the top drive system 100 to the tool string 2). Couplings 170 may include, for example, threaded couplings, hydraulic couplings, pneumatic couplings, electronic couplings, fiber optic couplings, power couplings, data couplings, and/or signal couplings. When the drive unit 110 is coupled to the tool adapter 150, top drive system 100 may transfer bi-directional torque, load, power, data, and/or signals between the top drive and the tool.

Figure 3:
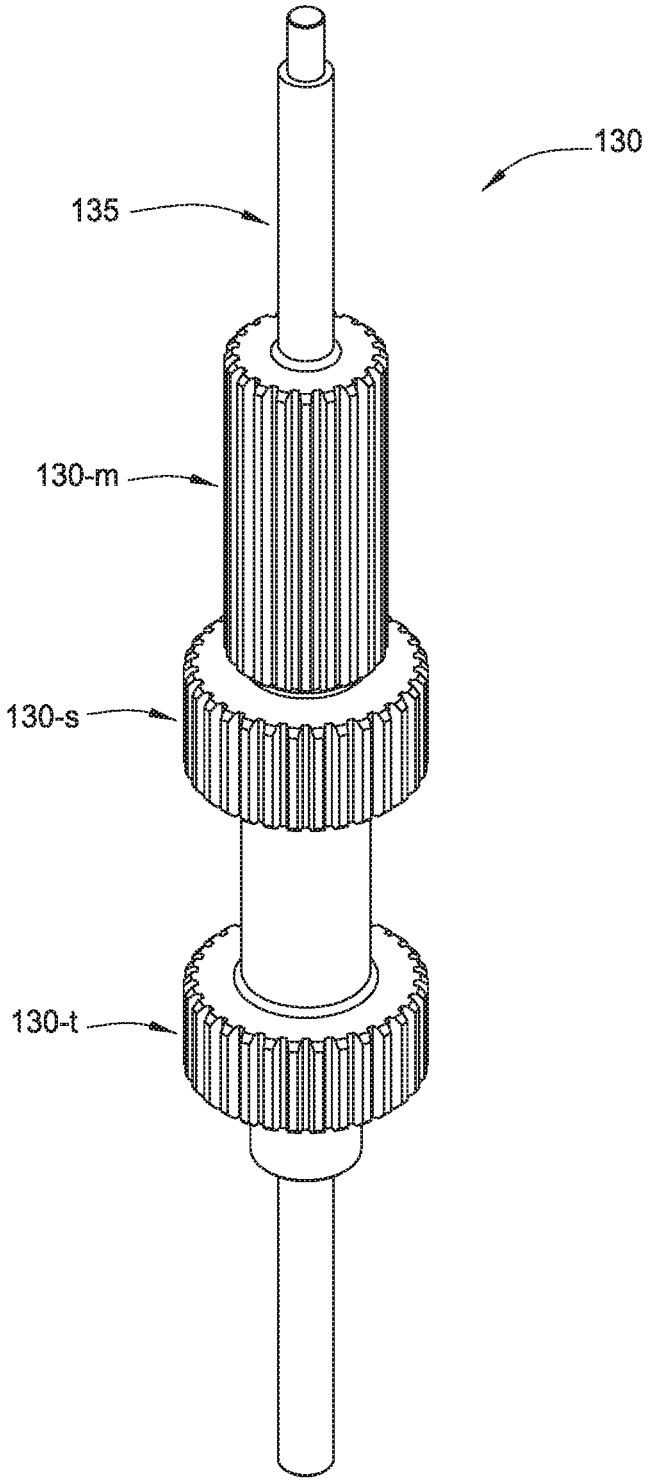
FIG. 3 illustrates drive gears of the top drive system of FIG. 2.

As illustrated in FIG. 3, each drive gears 130 includes three gear profiles 130-*m*, 130-*s*, and 130-*t*, axially aligned on a common shaft 135. The length, radius, and location along shaft 135 of each gear profile 130-*m*, 130-*s*, and 130-*t* are selected so that drive gears 130 may (a) simultaneously engage motors 140 and drive stem 180, or (b) simultaneously engage motors 140 and torque shaft 190, but (c) never simultaneously engage drive stem 180 and torque shaft 190. For ease of discussion, the illustrated length, radius, and location along shaft 135 of each gear profile 130-*m*, 130-*s*, and 130-*t* will be discussed herein, however other lengths, radii, and locations may be considered that satisfy conditions (a), (b), and (c), above. In some embodiments, gear profile 130-*m* may be permanently engaged with motors 140. Drive gears 130 may be constructed (e.g., forged) from a single material, or drive gears 130 may be an assembly of components. Each gear profile 130-*m*, 130-*s*, and 130-*t* may have teeth designed to mesh with gearing connected—directly or indirectly—to motors 140, drive stem 180, and torque shaft 190, respectively. Alternatively, gear profiles 130-*m*, 130-*s*, and 130-*t* may be configured to engage belt drive, chain drive, or other systems that are capable of conveying rotation.

Figures 4A, 4B:
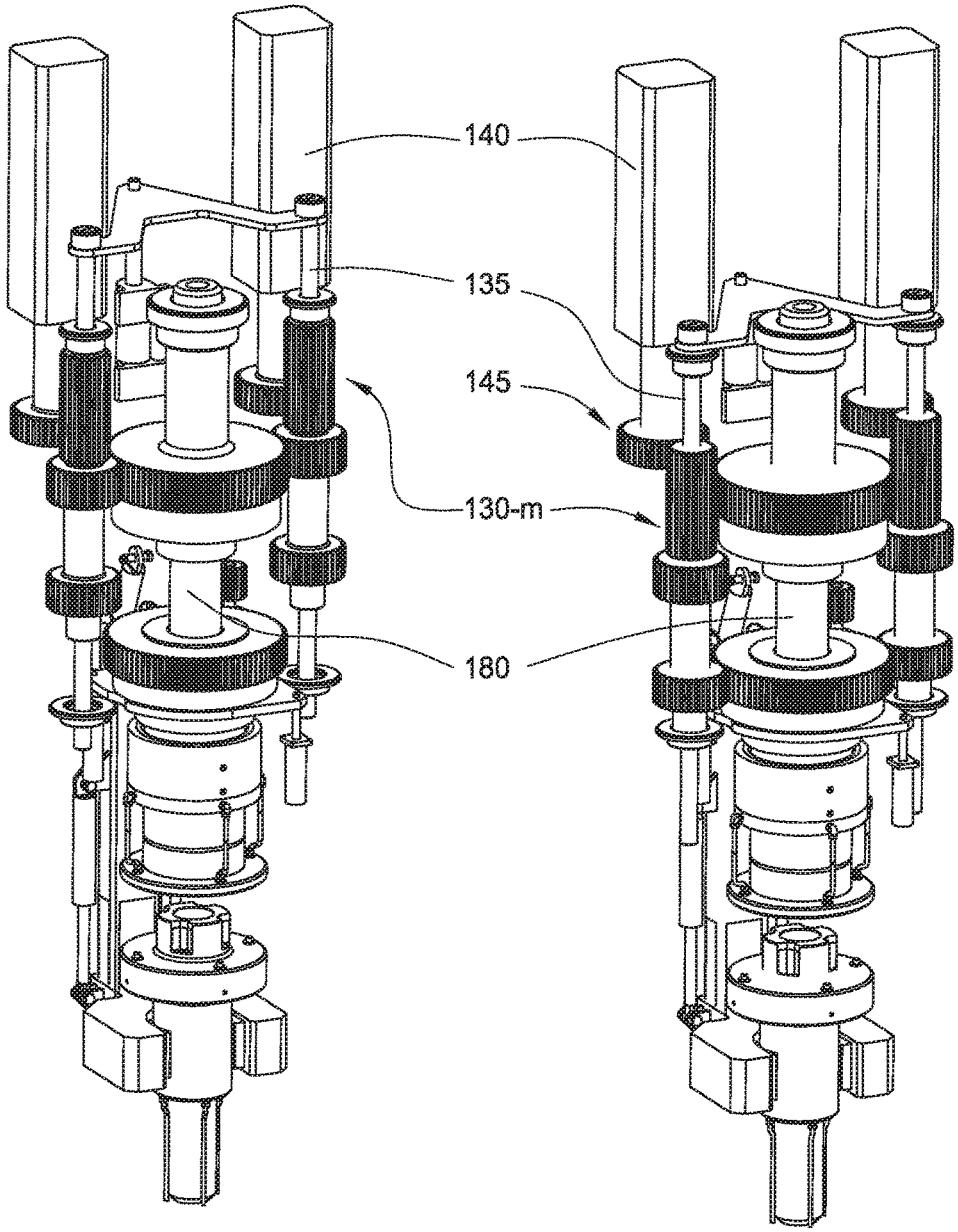
FIGS. 4A-4B illustrate configurations of the drive gears of the top drive system of FIG. 2.

As illustrated in FIGS. 4A-4B, drive gears 130 may engage motors 140. The extent of gear profile 130-*m* along shaft 135 may be sufficient to engage motor gear 145 when drive gears 130 is both in an upper position (shown in FIGS. 4A and 5) and in a lower position (shown in FIGS. 4B and 6). Motor 140 may turn motor gear 145, which engages gear profile 130-*m*, thereby turning drive gears 130.

Figure 5:
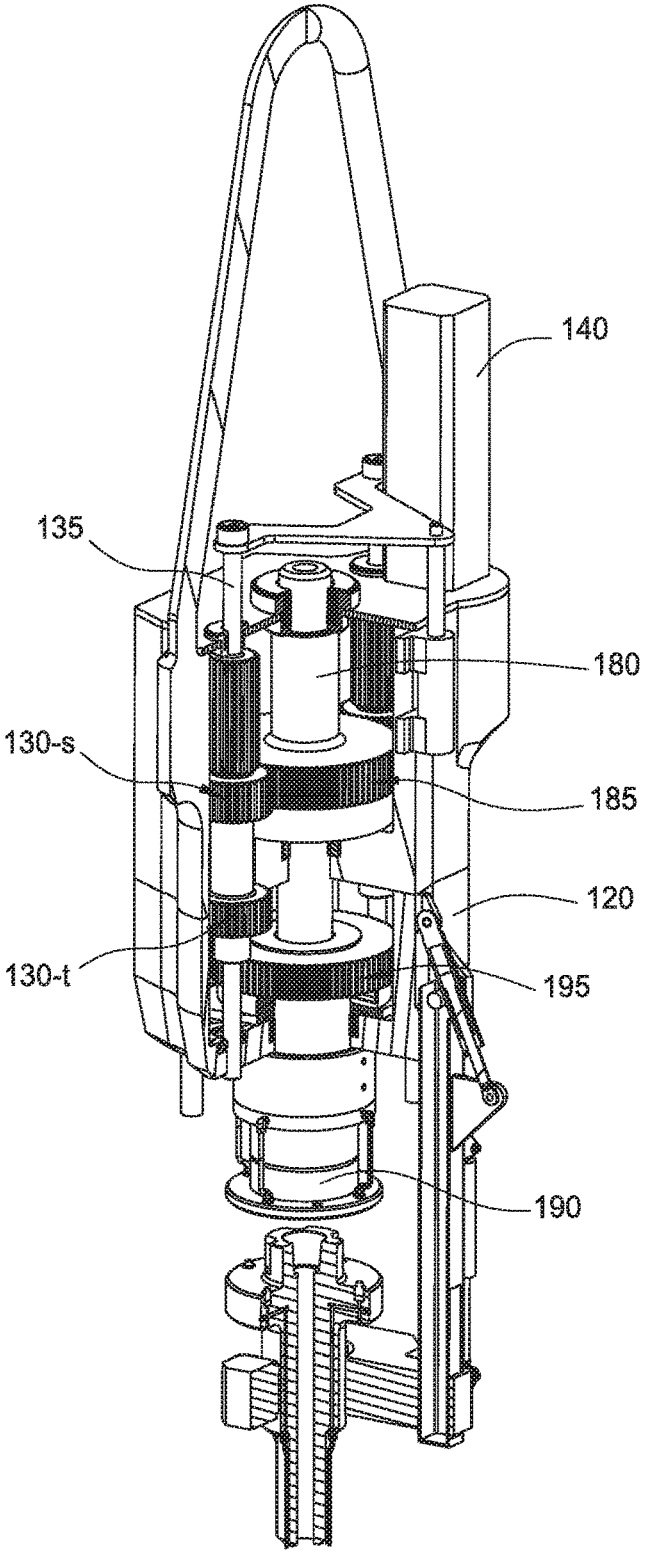
FIG. 5 illustrates another configuration of the drive gears of the top drive system of FIG. 2.

As illustrated in FIG. 5, drive gears 130 may engage drive stem 180. Gear profile 130-*s* may engage drive stem gear 185 when drive gears 130 is in an upper position (shown in FIG. 5). When drive gears 130 is in an upper position, drive gears 130 may turn gear profile 130-*s*, which engages drive stem gear 185, thereby turning drive stem 180. However, when drive gears 130 is in the upper position, gear profile 130-*t* is not engaged with torque shaft gear 195.

Figure 6:
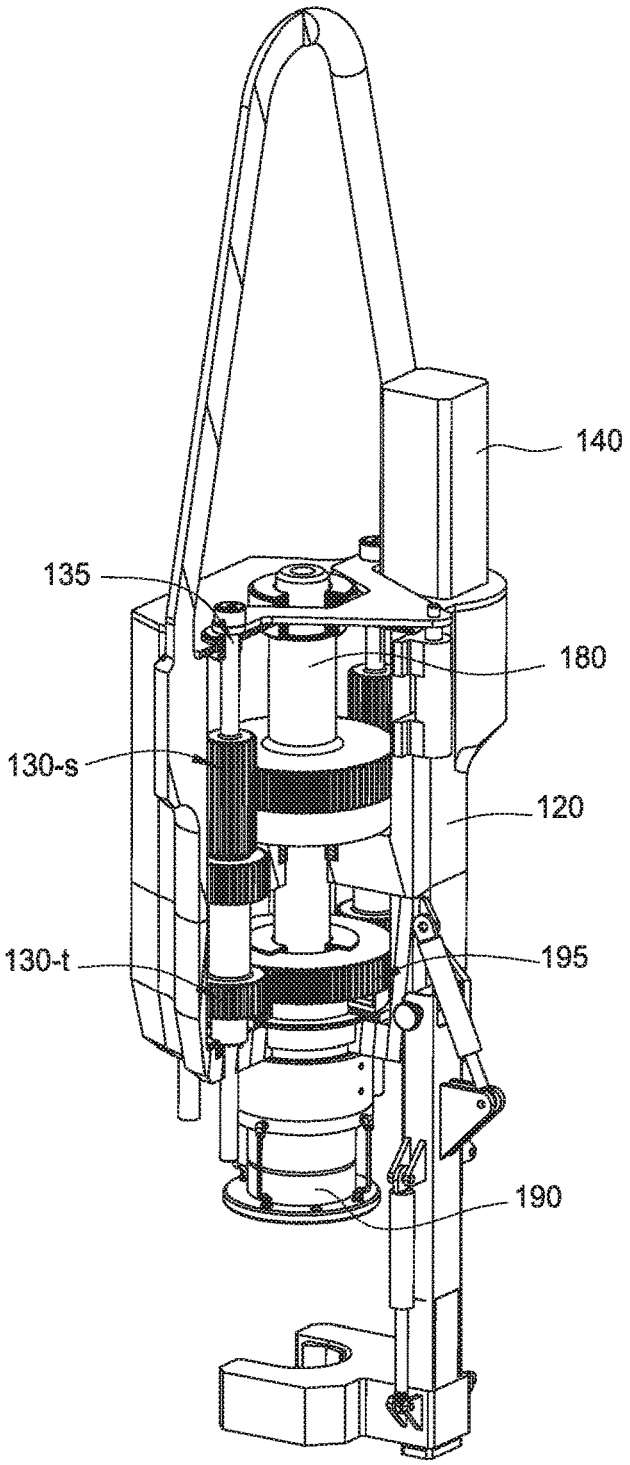
FIG. 6 illustrates another configuration of the drive gears of the top drive system of FIG. 2.

As illustrated in FIG. 6, drive gears 130 may engage torque shaft 190. Gear profile 130-*t* may engage torque shaft gear 195 when drive gears 130 is in a lower position (shown in FIGS. 4 and 6). When drive gears 130 is in a lower position, drive gears 130 may turn gear profile 130-*t*, which engages torque shaft gear 195, thereby turning torque shaft 190. However, when drive gears 130 is in the lower position, gear profile 130-*s* is not engaged with drive stem gear 185.

Figure 7:
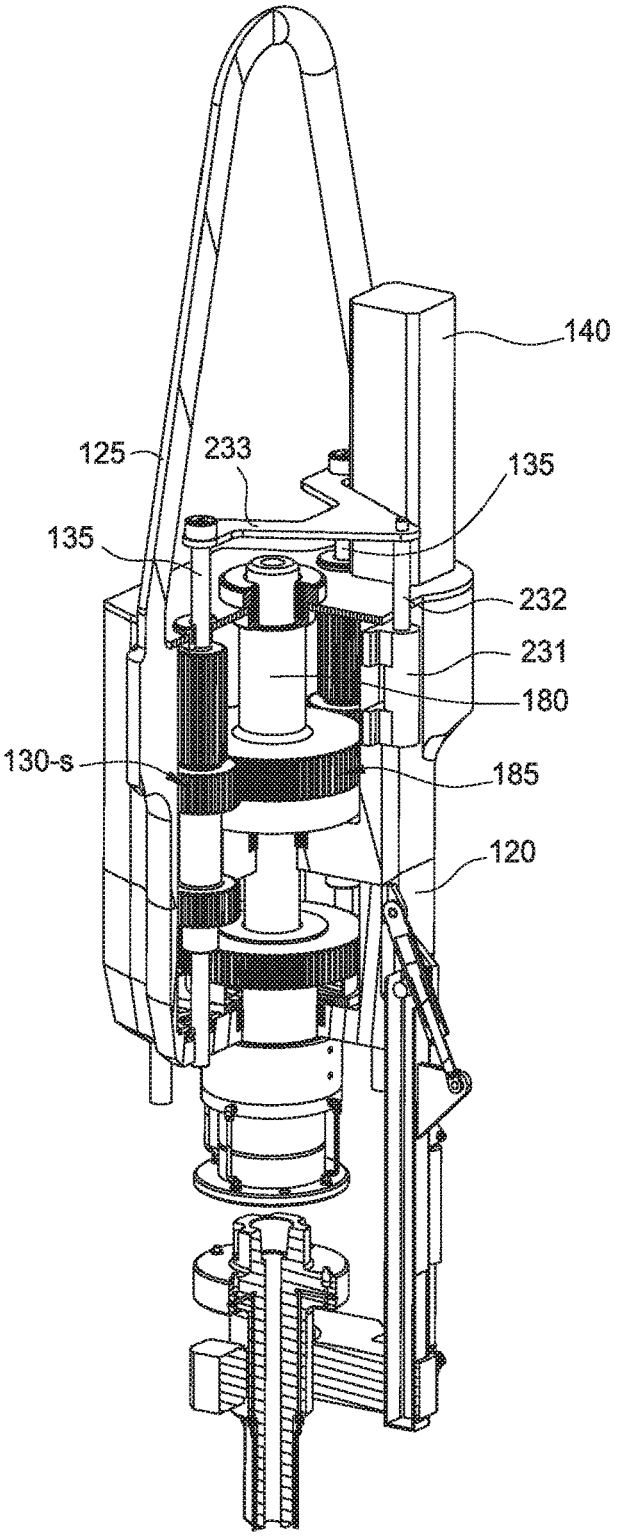
FIG. 7 illustrates operation of the drive gears of the top drive system of FIG. 2.

Drive gears 130 may shift between a first position, wherein drive gears 130 engage—directly or indirectly—with drive stem 180, and a second position, wherein drive gears 130 engage—directly or indirectly—with torque shaft 190. For example, in the embodiment illustrated in FIG. 7, a shift actuator 231 may cause drive gears 130 to move vertically, thereby shifting between the first position (e.g., the upper position of FIG. 5) and the second position (e.g., the lower position of FIGS. 4 and 6). In the illustrated embodiment, shift actuator 231 is a linear actuator. Shift actuator 231 extends and retracts shift arm 232, thereby causing shift plate 233 to translate vertically. As illustrated, shift plate 233 connects to two drive gear shafts 135. Vertical translation of shift plate 233 causes each of the drive gear shafts 135 to move vertically, thereby shifting drive gears 130 between the first position and the second position. In some embodiments, drive gears 130 may shift among more than two positions. For example, shifting drive gears 130 to a third position (not shown) may disengage drive gears 130 from motors 140. It should be appreciated that other shift actuator 231 types and/or configurations may be considered to accommodate manufacturing and operational conditions.

Figure 8B:
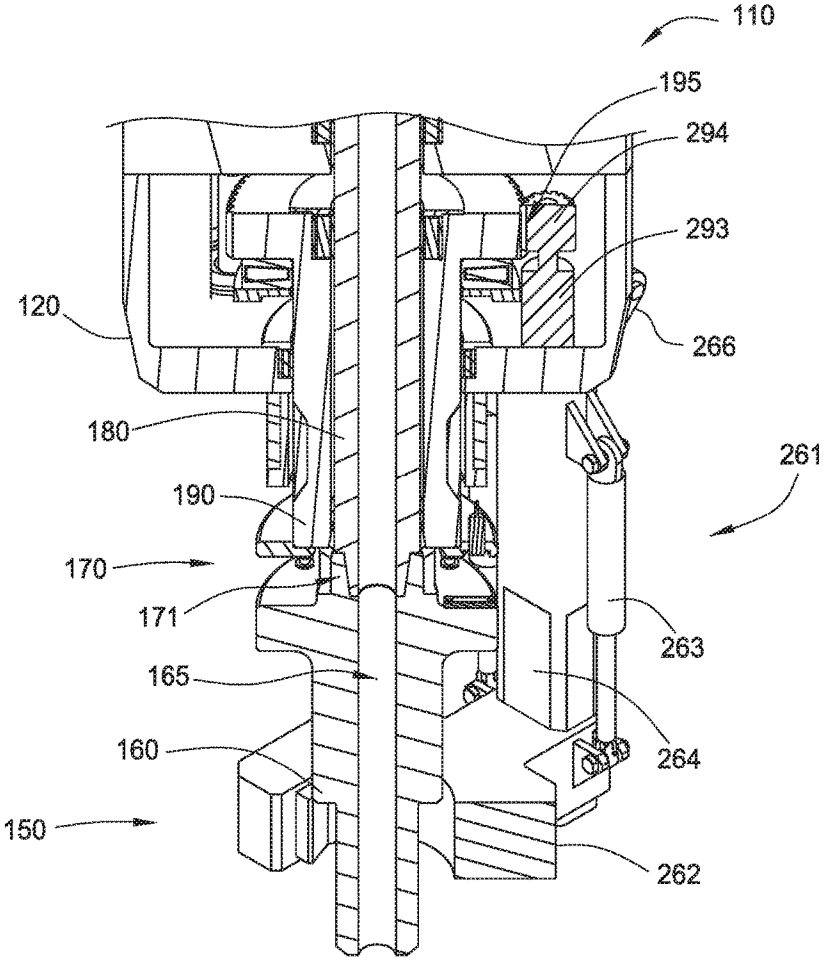
FIGS. 8A-8C illustrate coupling between a drive unit and a tool adapter of the top drive system of FIG. 2.
Figure 8A:
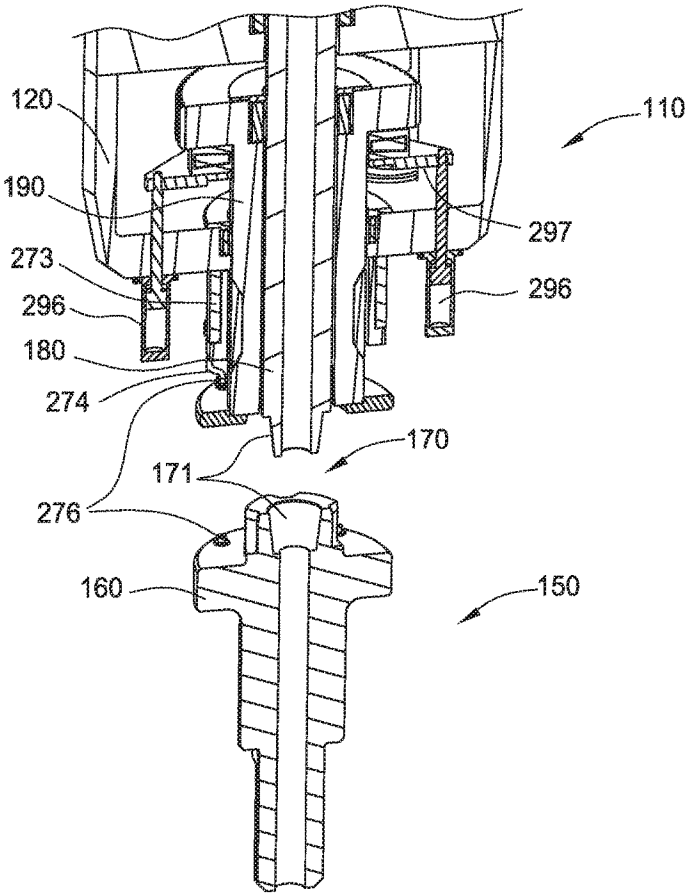

Drive unit 110 may be coupled to tool adapter 150 in order to transfer bi-directional torque, load, power, data, and/or signals between the top drive and the tool. Coupling of drive unit 110 to tool adapter 150 may proceed as a multi-step process. In one embodiment, as illustrated in FIGS. 8A-8B, the coupling begins with axial load coupling between drive stem 180 and tool stem 160. When drive gears 130 engage drive stem 180 (e.g., drive gears 130 in the upper position shown in FIG. 5), torque may be provided to make up or break out the connection between tool stem 160 and drive stem 180. For example, when couplings 170 include threaded couplings 171 between tool stem 160 and drive stem 180, torque of drive stem 180 may cause threading (or unthreading, depending on direction) between tool stem 160 and drive stem 180. In some embodiments, couplings 170 may include a rotary shouldered connection, such as an 8⅝" API regular, NC77 connection. The drive stem 180 may have RH male threading, while the tool stem 160 may have RH female threading. When tool stem 160 is coupled to drive stem 180, as shown in FIG. 8B, axial load may be transferred between the top drive and the tool. Likewise, when tool stem 160 is coupled to drive stem 180, central bore 165 may provide fluid communication between the top drive and the tool. It should be appreciated that, when tool stem 160 is coupled to drive stem 180, torque in the direction of the threaded couplings 171 may also be transferred between the top drive and the tool. For example, torque may be transferred from the motors 140 through motor gears 145 to the gear profiles 130-*m*, to the shafts 135, to the gear profiles 130-*s*, through drive stem gears to the drive stem 180, through the threaded couplings 171, to the tool stem 160, and to the tool string 2.

Figure 9A:
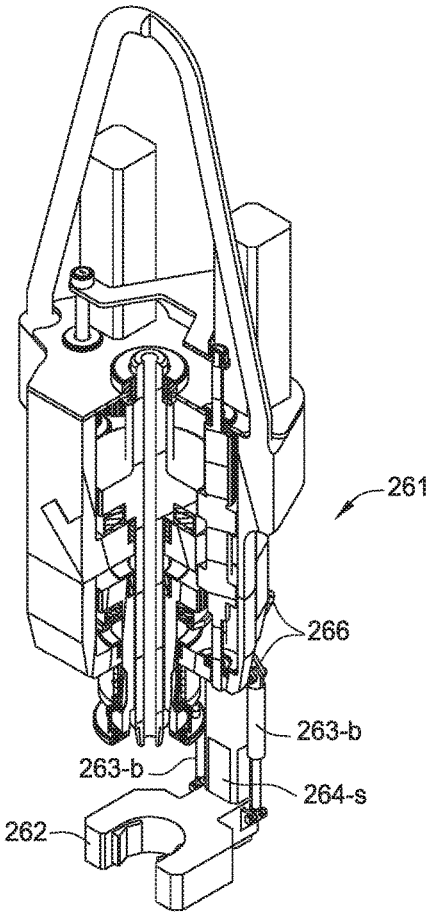
FIGS. 9A-9B illustrate a position adapter of the drive unit of FIG. 8.
Figure 9B:
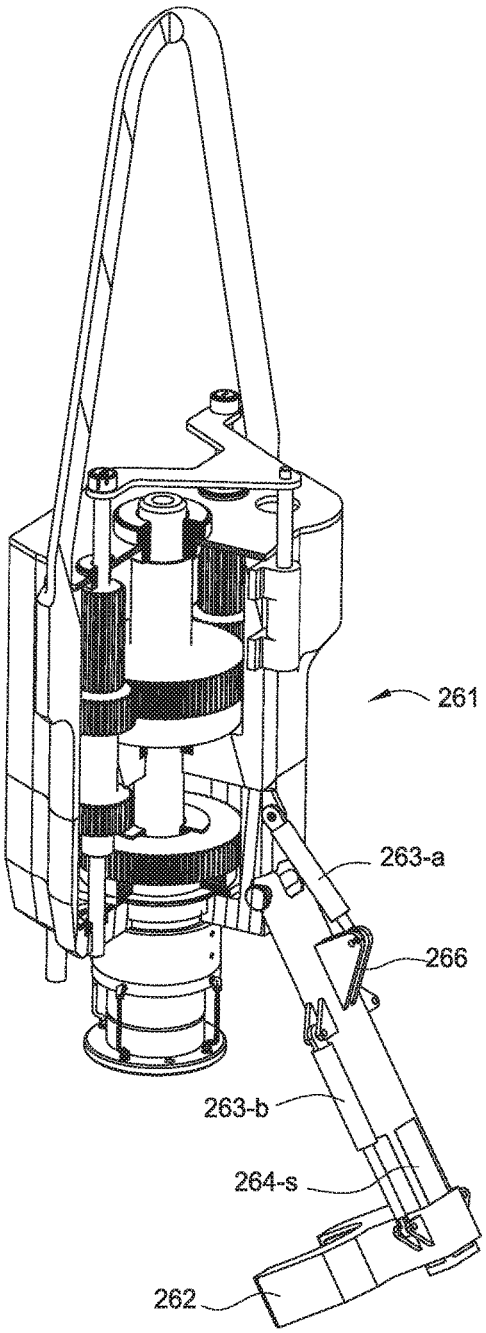

In some embodiments, coupling drive stem 180 to tool stem 160 may be facilitated with various sensors, actuators, couplers, and/or adapters. For example, tool stem 160 may be positioned for coupling and supported while coupling by a positioning adapter 261. The positioning adapter 261 may include a clamp 262 (e.g., an articulating claim), one or more actuators 263 (e.g., thread compensation cylinders), one or more supports 264 (e.g., a torque reaction post), and one or more hinges 266. The supports 264 and hinges 266 may fix positioning adapter 261 to housing 120. The actuators 263 may cause the hinges 266 and supports 264 to move clamp 262 into position to receive tool stem 160. In the embodiment illustrated in FIGS. 9A-9B, an actuator 263-*a* may rotate support 264-*s* between a vertical position, wherein clamp 262 encircles the central axis of the top drive system (FIG. 9A), and a tilted position, wherein clamp 262 is away from the central axis (FIG. 9B). Clamp 262 may firmly grip tool stem 160 while moving tool stem 160 into position to couple with drive stem 180. For example, tool stem 160 may have a clamp profile 267 (FIG. 9D) that provides additional grip between clamp 262 and tool stem 160. In the embodiment illustrated in FIGS. 9A-9B, a pair of actuators 263-*b* move clamp 262 along the length of support 264-*s*. Clamp 262 may thereby move tool stem 160 vertically when coupling (or decoupling) with drive stem 180. While coupling—for example while drive gears 130 engage and rotate drive stem 180, thereby threading threaded couplings 171—clamp 262 may prevent or reduce rotation of tool stem 160. Clamp 262 may continue to position and/or support tool stem 160 during bi-directional torque coupling. Clamp 262 may release tool stem 160, for example after load coupling and/or after bi-directional torque coupling, to allow rotation during drilling operations. It should be appreciated that other sensors, actuators, and/or adapters types and/or configurations may be considered to accommodate manufacturing and operational conditions.

Figure 8C:
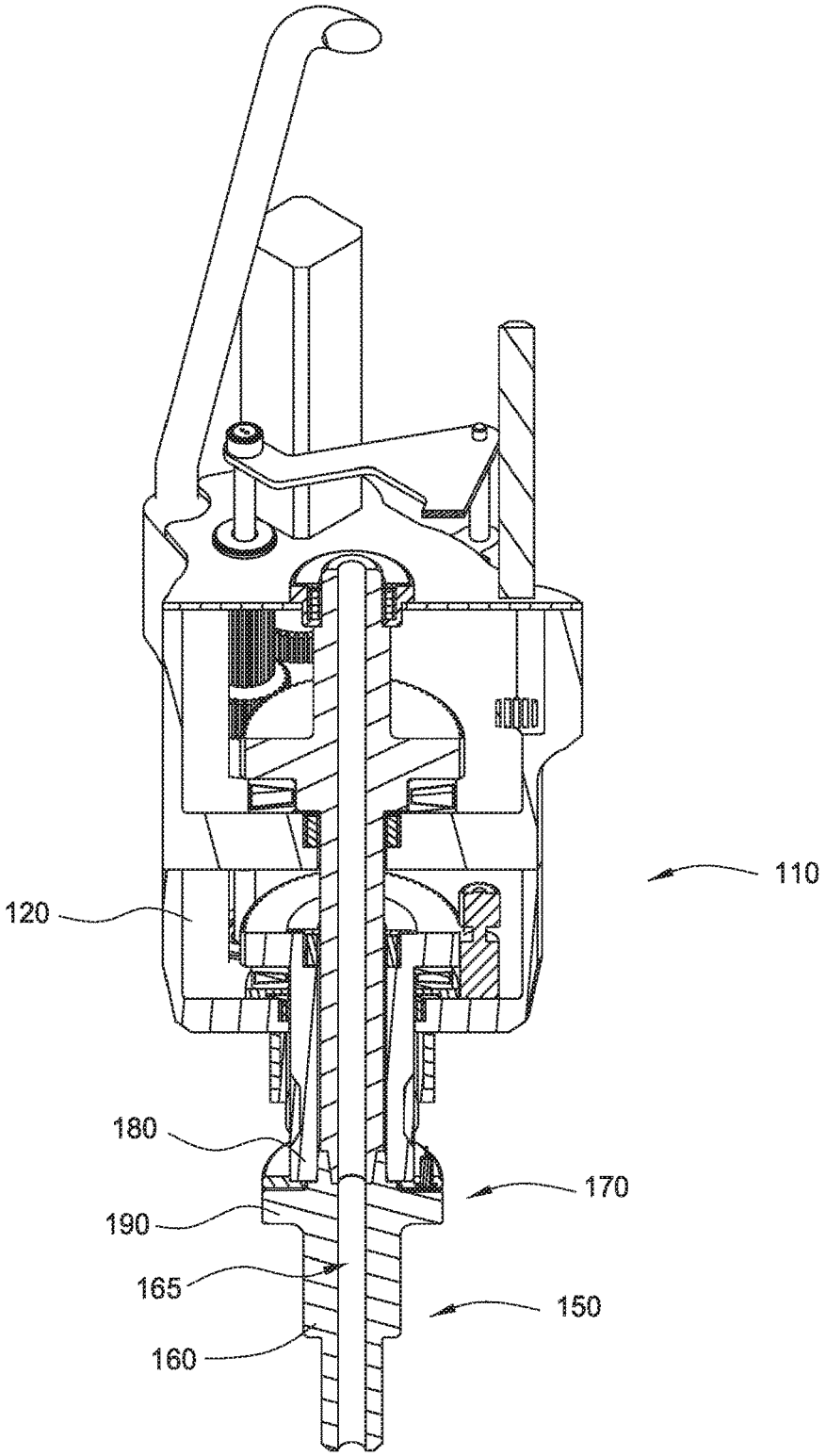

Coupling of drive unit 110 to tool adapter 150 may proceed with bi-directional torque coupling between torque shaft 190 and tool stem 160, as illustrated in FIGS. 8B-8C. The drive stem 180 may extend through a central bore of torque shaft 190. Torque shaft 190 may move vertically relative to drive stem 180. While tool stem 160 is coupling to drive stem 180, as shown in FIGS. 8A-8B, torque shaft 190 may be in a raised position (relative to drive stem 180; FIG. 8B). Torque shaft 190 may then move to a lowered position (relative to drive stem 180; FIG. 8C) to engage tool stem 160, thereby transferring torque. For example, couplings 170 may include key couplings 172 (FIGS. 9C-9D) for conveying torque between torque shaft 190 and tool stem 160. As illustrated, key couplings 172 may be disposed on an interior surface of torque shaft 190, and complementary key couplings 172 may be disposed on an exterior surface of tool stem 160. The key couplings 172 may have guiding chamfers. It should be appreciated that other torque coupling types and/or configurations may be considered to accommodate manufacturing and operational conditions. Clamp 262 may continue to position and/or support tool stem 160 during bi-directional torque coupling. Once torque shaft 190 has moved to a lowered position and coupled to tool stem 160, as shown in FIG. 8C, bi-directional torque may be transferred between the top drive and the tool. For example, drive gears 130 may engage torque shaft 190 (e.g., drive gears 130 in a lower position as shown in FIGS. 4 and 6), thereby providing torque to tool stem 160 during drilling operations. For example, torque may be transferred from the motors 140 through the motor gears 145 to the gear profiles 130-*m*, to the shafts 135, to the gear profiles 130-*t*, through the torque shaft gears 195 to the torque shaft 190, through the key couplings 172, to the tool stem 160, and to the tool string 2. The torque transfer path may thereby bypass threaded couplings 171.

Figures 9C, 9D:
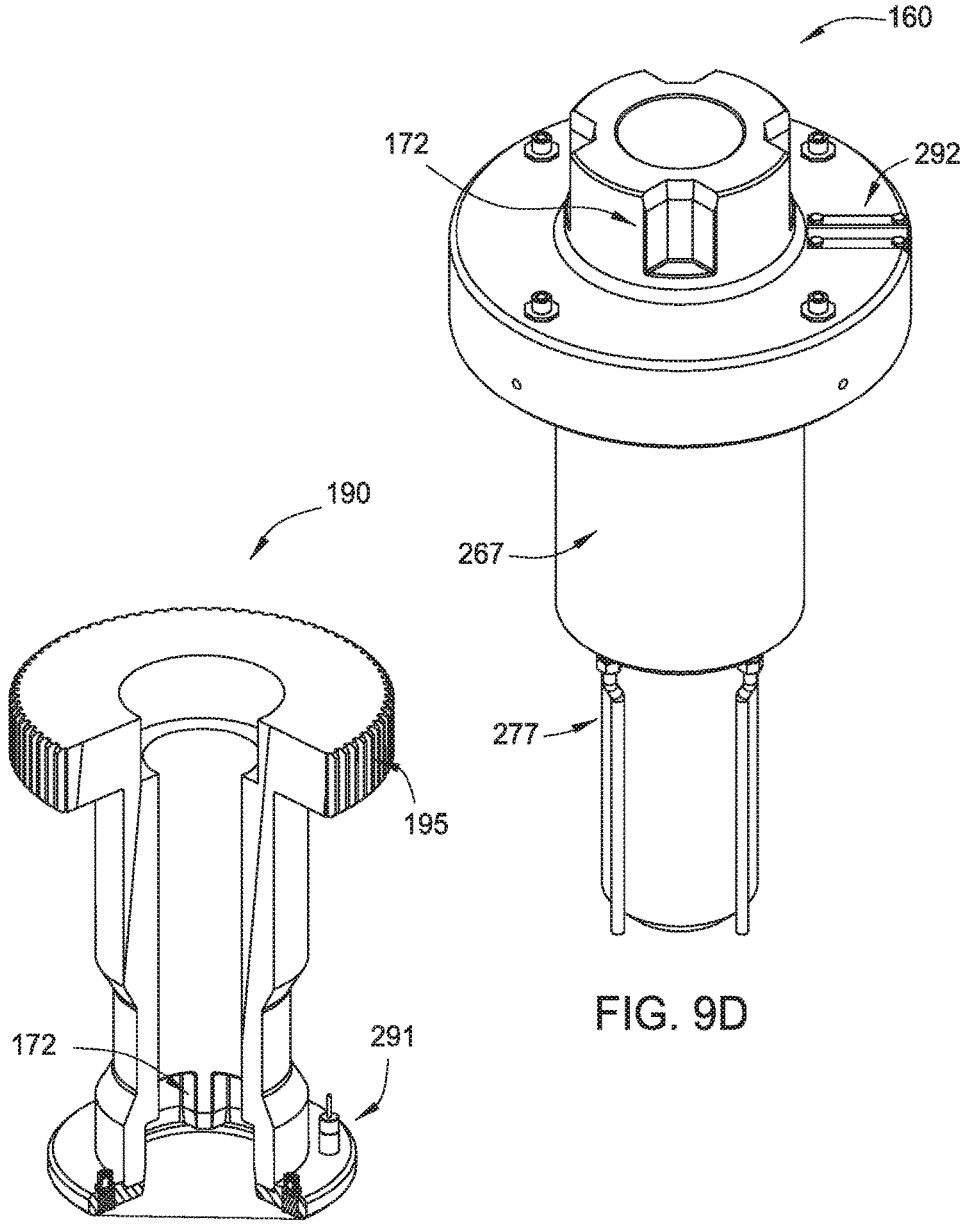
FIG. 9C illustrates a torque shaft of the drive unit of FIG. 8.
FIG. 9D illustrates a tool stem of the tool adapter of FIG. 8.

In some embodiments, coupling torque shaft 190 to tool stem 160 may be facilitated with various sensors, actuators, couplers, and/or adapters. For example, torque shaft 190 may be first oriented relative to tool stem 160 so that key couplings 172 align. A sensor 291 (e.g., an optical sensor; FIG. 9C) may be disposed at the base of torque shaft 190. The sensor 291 may be configured to detect a marker 292 (e.g., a reflector; FIG. 9D) disposed at the top of tool stem 160. Torque shaft 190 may be rotated relative to tool stem 160 until sensor 291 detects alignment with marker 292. Clamp 262 may continue to position and/or support tool stem 160 during bi-directional torque coupling. In some embodiments, an alignment motor 293 (FIG. 8B), disposed in housing 120, may rotate torque shaft 190 relative to tool stem 160. For example, alignment motor 293 may have an alignment gear 294 that is configured to engage with torque shaft gear 195 while torque shaft 190 is in the raised position. Alignment motor 293 may thereby rotate torque shaft 190 relative to tool stem 160 until sensor 291 detects alignment with marker 292. In some embodiments, tool stem 160 may be rotated relative to torque shaft 190. For example, as during load coupling, motors 140 may engage drive gears 130, thereby causing tool stem 180 to rotate. Threaded couplings 171 may then transfer the rotation to tool stem 160. In some embodiments, both alignment motor 293 may rotate torque shaft 190 relative to tool stem 160, and motors 140 may rotate tool stem 160 relative to torque shaft 190 until sensor 291 detects alignment with marker 292. In some embodiments, multiple markers 292 may be utilized. For example, torque shaft 190 may be appropriately oriented in two or more orientations relative to tool stem 160. Sensor 291 need only detect alignment with the first marker 292 to identify appropriate orientation of torque shaft 190 relative to tool stem 160.

As another example, movement of torque shaft 190 between the raised position (FIG. 8B) and the lowered position (FIG. 8C) may be facilitated with various sensors, actuators, couplers, and/or adapters. One or more support actuators 296 (e.g., hydraulic cylinders; FIG. 8A) may be configured to raise and lower a support plate 297. Torque shaft 190 may be connected to support plate 297 to couple vertical translational motion, but to allow free rotation therebetween. When support actuators 296 raises (or lowers) support plate 297, torque shaft 190 may be thereby raised (or lowered). However, when alignment motor 293 rotates torque shaft 190, support plate 297 remains fixed relative to housing 120.

As another example, connection of additional coupling 170 between torque shaft 190 and tool stem 160 may be facilitated with various sensors, actuators, couplers, and/or adapters. Couplings 170 may include one or more hydraulic, pneumatic, electrical, or optical couplings, providing fluid, electrical, optical, signal, data, and/or power communication between the drive unit 110 and the tool adapter 150. For example, as illustrated in FIG. 8A, couplings 170 may include a swivel 273 (e.g., a hydraulic swivel), lines 274, and connectors 276 (e.g., quick-connects). Swivel 273 may be disposed co-axially with torque shaft 190. Swivel 273 may encircle torque shaft 190. In some embodiments, swivel 273 may be fixed relative to housing 120 while allowing rotation between swivel 273 and torque shaft 190. In some embodiments, swivel 273 may be fixed relative to torque shaft 190 while allowing rotation between swivel 273 and housing 120. In some embodiments, swivel 273 may be free to rotate both relative to torque shaft 190 and housing 120. Lines 274 may extend from swivel 273 to the base of torque shaft 190. Connectors 276 at the base of torque shaft 190 may receive lines 274. Mating connectors 276 may be disposed at the top of tool stem 160. In some embodiments, a hydraulic coupling between torque shaft 190 and tool stem 160 may include a hydraulic path through swivel 273 and a line 274 to connector 276 at the base of torque shaft 190. When torque shaft 190 is connected to tool stem 160, connector 276 at the base of torque shaft 190 mates with connector 276 at the top of tool stem 160. Likewise, when torque shaft 190 is connected to tool stem 160, additional hydraulic, pneumatic, electrical, or optical couplings 170 between torque shaft 190 and tool stem 160 may be connected. In some embodiments, the fluid, electrical, optical, signal, data, and/or power communication may be extended to the tool string 2 via lines 277 along tool stem 160 (FIG. 9D).

As another example, the coupling of torque shaft 190 to tool stem 160 may be further facilitated with various sensors, actuators, couplers, and/or adapters. For example, the torque coupling may be facilitated with a locking adapter having related sensor(s) and actuator(s). Once torque shaft 190 has moved to the lowered position and coupled to tool stem 160, as shown in FIG. 8C, a locking adapter may hold torque shaft 190 in the lower position (coupled to tool stem 160). The locking adapter may be fixed to housing 120. For example, the locking adapter may be proximate alignment motor 293. A locking sensor may detect when torque shaft 190 has coupled with tool stem 160. A locking actuator may respond to the locking sensor by actuating the locking adapter. The locking adapter may resist vertical motion of the torque shaft 190 which could compromise the torque coupling between the torque shaft 190 and the tool stem 160. The locking adapter may permit rotation between the torque shaft 190 and the housing 120.

It should be appreciated that other sensors, actuators, and/or adapters types and/or configurations may be considered to accommodate manufacturing and operational conditions. The actuators may be, for example, worm drives, hydraulic cylinders, compensation cylinders, etc. The actuators may be hydraulically, electrically, and/or manually controlled. In some embodiments, multiple control mechanism may be utilized to provide redundancy. One or more sensors may be used to monitor relative positions of the components of the top drive system 100. The sensors may be position sensors, rotation sensors, pressure sensors, optical sensors, magnetic sensors, etc. In some embodiments, stop surfaces may be used in conjunction with or in lieu of sensors to identify when components are appropriately positioned and or oriented (e.g., when drive gears 130 are in an upper position, when tool stem 160 is aligned with torque shaft 190, or when torque shaft 190 is in a lowered position). Likewise, optical guides may be utilized to identify or confirm when components are appropriately positioned and or oriented. In some embodiments, guide elements (e.g., pins and holes, chamfers, etc.) may assist in aligning and/or orienting the components of the top drive system 100.

Bearings and seals may be disposed between components to provide support, cushioning, rotational freedom, and/or fluid management.

Figure 10:
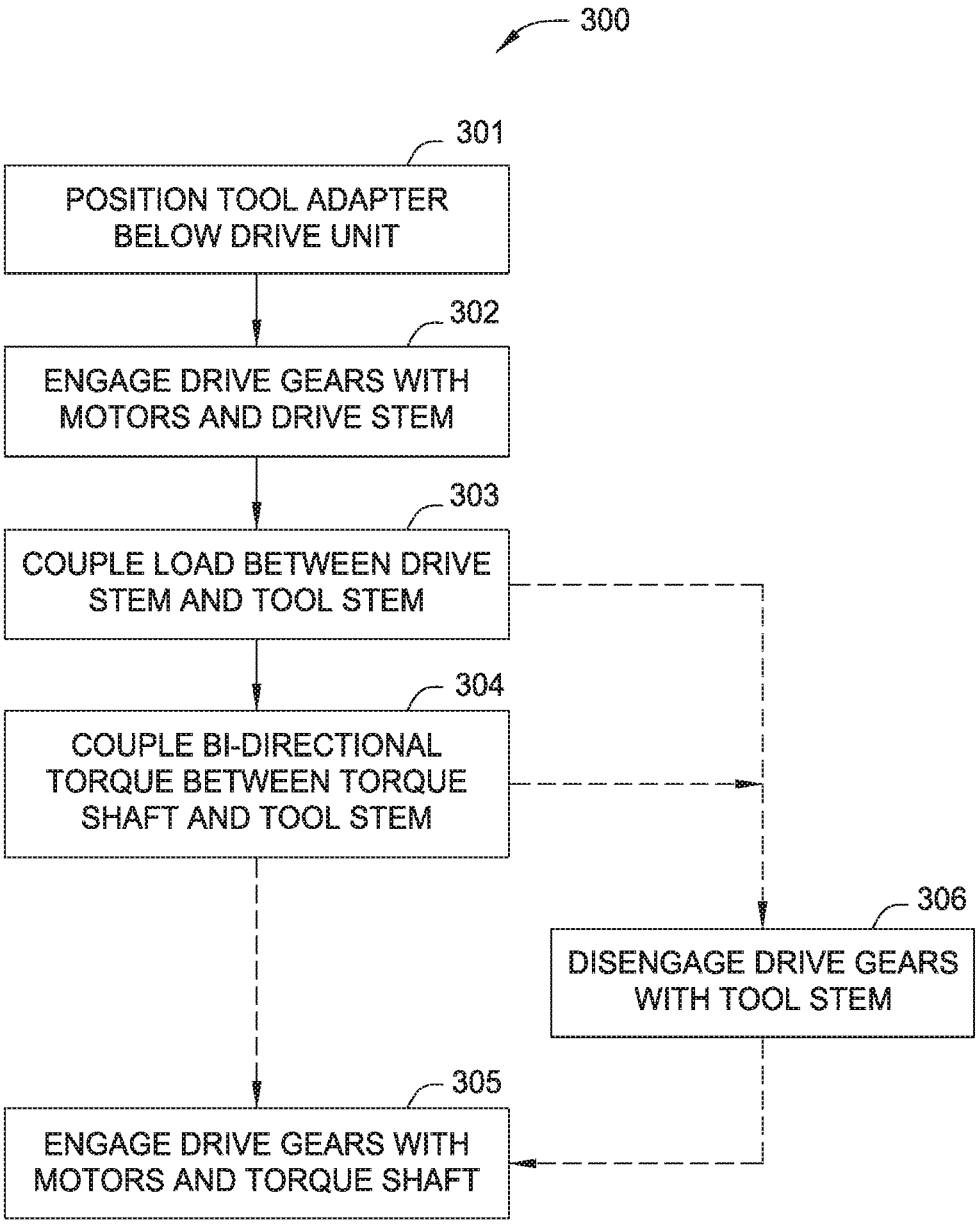
FIG. 10 illustrates a method of coupling the drive unit of FIG. 8 with the tool adapter of FIG. 8.

A method 300 of coupling drive unit 110 with tool adapter 150 is illustrated in FIG. 10. The method begins at step 301 wherein the tool adapter 150 is positioned below the drive unit 110. A positioning adapter 261 may be used to position a tool stem 160 of the tool adapter 150 below the drive unit 110. The tool stem 160 may be positioned so that threaded connections 171 between the tool stem 160 and a drive stem 180 of the drive unit 110 are readied for threading. The method 300 continues at step 302, wherein drive gears 130 of the drive unit 110 engage with motors 140 of the drive unit 110. At step 302, drive gears 130 also engage with the drive stem 180. Motors 140 transfer torque to drive gears 130, thereby transferring torque to drive stem 180. In some embodiments, drive gears 130 may be in an upper position, thereby engaging drive stem gear 185. Torque shaft 190 may also be in a raised position. The method 300 continues at step 303, wherein rotation of drive stem 180 relative to tool stem 160 causes threading of threaded connections 171 between the tool stem 160 and the drive stem 180, coupling load therebetween. It should be appreciated that, at the completion of step 303, torque in the direction of the threaded couplings 171 is also coupled between the tool stem 160 and the drive stem 180. The method continues at step 304, wherein a bi-directional torque coupling is established between torque shaft 190 and tool stem 160. For example, key couplings 172 on torque shaft 190 may be mated with key couplings 172 on tool stem 160. In some embodiments, a support actuator 296 may move support plate 297 from the raised position to a lowered position, thereby moving torque shaft 190 from a raised position to a lowered position, thereby mating key couplings 172. In At step 304, additional couplings 170 also may be connected, including one or more hydraulic, pneumatic, electrical, or optical couplings, thereby providing fluid, electrical, optical, signal, data, and/or power communication between the drive unit 110 and the tool adapter 150. In some embodiments, the method goes further at step 305 to transfer bi-directional torque, wherein drive gears 130 of the drive unit 110 engage with motors 140 of the drive unit 110. At step 305, drive gears 130 also engage with the torque shaft 190. In some embodiments, shift actuator 231 moves drive gears 130 from an upper position to a lower position to engage the drive gears 130 with the torque shaft 190. Motors 140 transfer torque to torque shaft 190, thereby transferring bi-directional torque to tool stem 160. In some embodiments, drive gears 130 may be in a lower position, thereby engaging torque shaft gear 195. After the load is coupled at step 303, but before bi-directional torque is transferred between the torque shaft 190 and the tool stem 160, at step 306 drive gears 130 disengage with tool stem 180. In some embodiments, disengaging the drive gears 130 with the tool stem 180 at step 306 occurs prior to coupling of bi-directional torque at step 304. In some embodiments, disengaging the drive gears 130 with the tool stem 180 at step 306 occurs subsequent to coupling of bi-directional torque at step 304. In some embodiments, shift actuator 231 moves drive gears 130 from an upper position to a lower position to disengage the drive gears 130 with the tool stem 180. It should be appreciated that drive unit 110 may be de-coupled from tool adapter 150 by reversing the steps of method 300.

In an embodiment, a drive unit of a top drive system includes a first, second, and third drive gears, wherein the first, second, and third drive gears are operationally coupled; a motor engagable with the first drive gear; a drive stem having a load coupling and engagable with the second drive gear; and a torque shaft having a torque coupling and engagable with the third drive gear, wherein the drive stem cannot engage with the second drive gear when the torque shaft is engaged with the third drive gear, and vice versa.

In one or more embodiments disclosed herein, the first, second, and third drive gears are axially aligned on a common shaft.

In one or more embodiments disclosed herein, the load coupling is a threaded coupling.

In one or more embodiments disclosed herein, the torque coupling is a key coupling.

In one or more embodiments disclosed herein, the drive stem extends through a central bore of the torque shaft.

In one or more embodiments disclosed herein, the drive unit also includes a swivel co-axial with the torque shaft.

In one or more embodiments disclosed herein, the swivel is a hydraulic swivel.

In one or more embodiments disclosed herein, the drive unit also includes a shift actuator coupled to the first, second, and third drive gears, wherein the shift actuator is configured to move the first, second, and third drive gears between: an upper position wherein the second drive gear engages with the drive stem, and a lower position wherein the third drive gear engages with the torque shaft.

In one or more embodiments disclosed herein, the drive unit also includes a support actuator configured to move the torque shaft between: a raised position wherein the torque shaft is engaged with an alignment gear, and a lowered position wherein the torque shaft is disengaged with the alignment gear.

In one or more embodiments disclosed herein, the drive unit also includes a positioning adapter configured to move between a vertical position and a tilted position relative to the drive unit.

In one or more embodiments disclosed herein, the top drive system also includes a tool adapter having a complementary load coupling to the load coupling of the drive stem, and a complementary torque coupling to the torque coupling of the torque shaft.

In one or more embodiments disclosed herein, the drive unit further comprises a support actuator configured to move the torque shaft between: a raised position wherein the torque shaft is engaged with an alignment gear, and a lowered position wherein the torque shaft is coupled to the tool adapter.

In one or more embodiments disclosed herein, the drive unit further comprises a positioning adapter having a clamp; the tool adapter comprises a tool stem having a clamp profile; and the clamp is configured to engage the clamp profile to move the tool stem into position to couple with the drive stem.

In one or more embodiments disclosed herein, the top drive system also includes at least one coupling between the drive unit and the tool adapter selected from a group consisting of: threaded couplings, hydraulic couplings, pneumatic couplings, electronic couplings, fiber optic couplings, power couplings, data couplings, signal couplings, bi-directional torque couplings, axial load couplings, power couplings, data couplings, and signal couplings.

In an embodiment, a method of coupling a drive unit to a tool adapter includes positioning the tool adapter below the drive unit; engaging a first drive gear with a motor of the drive unit while engaging a second drive gear with a drive stem of the drive unit; coupling a load between the drive stem and a tool stem of the tool adapter; and coupling a torque between a torque shaft of the drive unit and the tool stem.

In one or more embodiments disclosed herein, the method also includes engaging the first drive gear with the motor while engaging a third drive gear with the torque shaft.

In one or more embodiments disclosed herein, the method also includes, after coupling the load between the drive stem and the tool stem, and before engaging the third drive gear with the torque shaft, disengaging the second drive gear with the drive stem.

In one or more embodiments disclosed herein, the disengaging the second drive gear with the drive stem follows the coupling the torque between the torque shaft of the drive unit and the tool stem.

In one or more embodiments disclosed herein, the method also includes moving the first and second drive gears from an upper position to a lower position to disengage the motor from the drive stem.

In one or more embodiments disclosed herein, the method also includes moving the torque shaft from a raised position to a lowered position to couple the torque.

In one or more embodiments disclosed herein, the method also includes moving a positioning adapter from a tilted position to a vertical position to position the tool adapter below the drive unit.

In one or more embodiments disclosed herein, coupling the load comprises rotating the drive stem relative to the tool stem in a first direction.

In one or more embodiments disclosed herein, the method also includes rotating the tool stem in the first direction.

In one or more embodiments disclosed herein, rotating the tool stem in the first direction comprises engaging the first drive gear with the motor while engaging a third drive gear with the torque shaft.

In one or more embodiments disclosed herein, coupling the torque comprises lowering the torque shaft relative to the tool stem.

In one or more embodiments disclosed herein, the method also includes aligning the torque shaft with the tool stem before lowering the torque shaft relative to the tool stem.

In one or more embodiments disclosed herein, the method also includes forming a coupling between the drive unit and the tool adapter, wherein the coupling is selected from a group consisting of: threaded couplings, hydraulic couplings, pneumatic couplings, electronic couplings, fiber optic couplings, power couplings, data couplings, signal couplings, bi-directional torque couplings, axial load couplings, power couplings, data couplings, and signal couplings.

In an embodiment, a top drive system includes a drive unit; a tool adapter having a tool stem; a first torque path including: a motor of the drive unit; a first pair of operationally coupled drive gears of the drive unit; a drive stem of the drive unit; a threaded connection between the drive stem and the tool stem; and a second torque path including: the motor; a second pair of operationally coupled drive gears of the drive unit; a torque shaft of the drive unit; and a torque coupling between the torque shaft and the tool stem.

In one or more embodiments disclosed herein, the second torque path bypasses the threaded connection between the drive stem and the tool stem.

In one or more embodiments disclosed herein, the first pair of drive gears and the second pair of drive gears share a common gear.

While the foregoing is directed to embodiments of the present invention, other and further embodiments of the invention may be devised without departing from the basic scope thereof, and the scope thereof is determined by the claims that follow.

The invention claimed is:

1. A drive unit of a top drive system comprising:

a first, second, and third drive gears, wherein the first, second, and third drive gears are operationally coupled;

a motor engagable with the first drive gear;

a drive stem having a load coupling and engagable with the second drive gear; and a torque shaft having a torque coupling and engagable with the third drive gear, wherein the drive stem cannot engage with the second drive gear when the torque shaft is engaged with the third drive gear, and vice versa.

2. The drive unit of claim 1, wherein the first, second, and third drive gears are axially aligned on a common shaft.

3. The drive unit of claim 1, wherein the load coupling is a threaded coupling and the torque coupling is a key coupling.

4. The drive unit of claim 1, further comprising a shift actuator coupled to the first, second, and third drive gears, wherein the shift actuator is configured to move the first, second, and third drive gears between:

an upper position wherein the second drive gear engages with the drive stem, and a lower position wherein the third drive gear engages with the torque shaft.

5. The drive unit of claim 1, further comprising a support actuator configured to move the torque shaft between:

a raised position wherein the torque shaft is engaged with an alignment gear, and a lowered position wherein the torque shaft is disengaged with the alignment gear.

6. The top drive system of claim 1, further comprising a tool adapter having a complementary load coupling to the load coupling of the drive stem, and a complementary torque coupling to the torque coupling of the torque shaft.

7. The top drive system of claim 6, wherein the drive unit further comprises a support actuator configured to move the torque shaft between:

a raised position wherein the torque shaft is engaged with an alignment gear, and a lowered position wherein the torque shaft is coupled to the tool adapter.

8. The top drive system of claim 6, wherein:

the drive unit further comprises a positioning adapter having a clamp;

the tool adapter comprises a tool stem having a clamp profile; and the clamp is configured to engage the clamp profile to move the tool stem into position to couple with the drive stem.

9. A method of coupling a drive unit to a tool adapter comprising:

positioning the tool adapter below the drive unit;

engaging a first drive gear with a motor of the drive unit while engaging a second drive gear with a drive stem of the drive unit;

coupling a load between the drive stem and a tool stem of the tool adapter; and coupling a torque between a torque shaft of the drive unit and the tool stem.

10. The method of claim 9, further comprising engaging the first drive gear with the motor while engaging a third drive gear with the torque shaft.

11. The method of claim 10, further comprising, after coupling the load between the drive stem and the tool stem, and before engaging the third drive gear with the torque shaft, disengaging the second drive gear with the drive stem.

12. The method of claim 11, wherein the disengaging the second drive gear with the drive stem follows the coupling the torque between the torque shaft of the drive unit and the tool stem.

13. The method of claim 9, further comprising moving the first and second drive gears from an upper position to a lower position to disengage the motor from the drive stem.

14. The method of claim 9, further comprising moving the torque shaft from a raised position to a lowered position to couple the torque.

15. The method of claim 9, wherein coupling the load comprises rotating the drive stem relative to the tool stem in a first direction, the method further comprising rotating the tool stem in the first direction.

16. The method of claim 15, wherein rotating the tool stem in the first direction comprises engaging the first drive gear with the motor while engaging a third drive gear with the torque shaft.

17. The method of claim 9, wherein coupling the torque comprises lowering the torque shaft relative to the tool stem.

18. A top drive system comprising:
- a drive unit;
- a tool adapter having a tool stem;
- a first torque path including:
  - a motor of the drive unit;
  - a first pair of operationally coupled drive gears of the drive unit;
  - a drive stem of the drive unit;
  - a threaded connection between the drive stem and the tool stem; and
- a second torque path including:
  - the motor;
  - a second pair of operationally coupled drive gears of the drive unit;
  - a torque shaft of the drive unit; and
  - a torque coupling between the torque shaft and the tool stem.

19. The top drive system of claim 18, wherein the second torque path bypasses the threaded connection between the drive stem and the tool stem.

20. The top drive system of claim 18, wherein the first pair of drive gears and the second pair of drive gears share a common gear.

* * * * *